US005765853A

United States Patent [19]

Erb

[11] Patent Number: 5,765,853

[45] Date of Patent: Jun. 16, 1998

[54] SNOWBOARD BINDING WHICH PERMITS ANGULAR REORIENTATION OF A USER'S FOOT WHILE MAINTAINING THAT FOOT ATTACHED TO THE SNOWBOARD

[76] Inventor: George A. Erb, 2086 Cervato Dr., Camarillo, Calif. 93012

[21] Appl. No.: 613,089

[22] Filed: Mar. 8, 1996

Related U.S. Application Data

[63] Continuation-in-part of Ser. No. 418,253, Apr. 6, 1995, Pat. No. 5,553,883.

[51] Int. Cl.[6] ..... A63C 9/081

[52] U.S. Cl. ..... 280/607; 280/618; 280/14.2; 441/70

[58] Field of Search ..... 280/607, 617, 280/618, 611, 613, 620, 630, 633, 634, 636, 14.2; 441/70, 74, 75, 65

[56] References Cited

U.S. PATENT DOCUMENTS

| | | | |
|---|---|---|---|
| 5,344,179 | 9/1994 | Fritschi | 280/142 |
| 5,354,088 | 10/1994 | Vetter | 280/14.2 |
| 5,356,170 | 10/1994 | Carpenter et al. | 280/618 |
| 5,553,883 | 9/1996 | Erb | 280/14.2 |
| 5,577,755 | 11/1996 | Metzger | 280/14.2 |

*Primary Examiner*—Richard M. Camby
*Attorney, Agent, or Firm*—Terry M. Gernstein

[57] ABSTRACT

A binding that attaches a user's foot to a snowboard includes a footplate that is rotatably and continuously fixed to the snowboard and which is attached to the user's foot via straps and a rear support which contact a snowboot. An anchor fixes the footplate to the snowboard with the bottom of the footplate as close to the snowboard as possible whereby the bottom of a snowboarder's foot is as close to the plane of the snow as possible, and is slidably engaged with the footplate to permit that footplate to rotate while remaining attached to the snowboard. Anti-pivot spring pins located outside the outer perimeter of a user's snowboot accurately and repeatable secure the footplate to the snowboard once the footplate is in the selected angular orientation on the snowboard. A top plate includes a plurality of pin-receiving holes defined therein for receiving the spring pins. The anchor includes a top plate which is slidably connected to the footplate by an annular flange on the footplate fitted beneath an annular flange on the top plate.

31 Claims, 5 Drawing Sheets

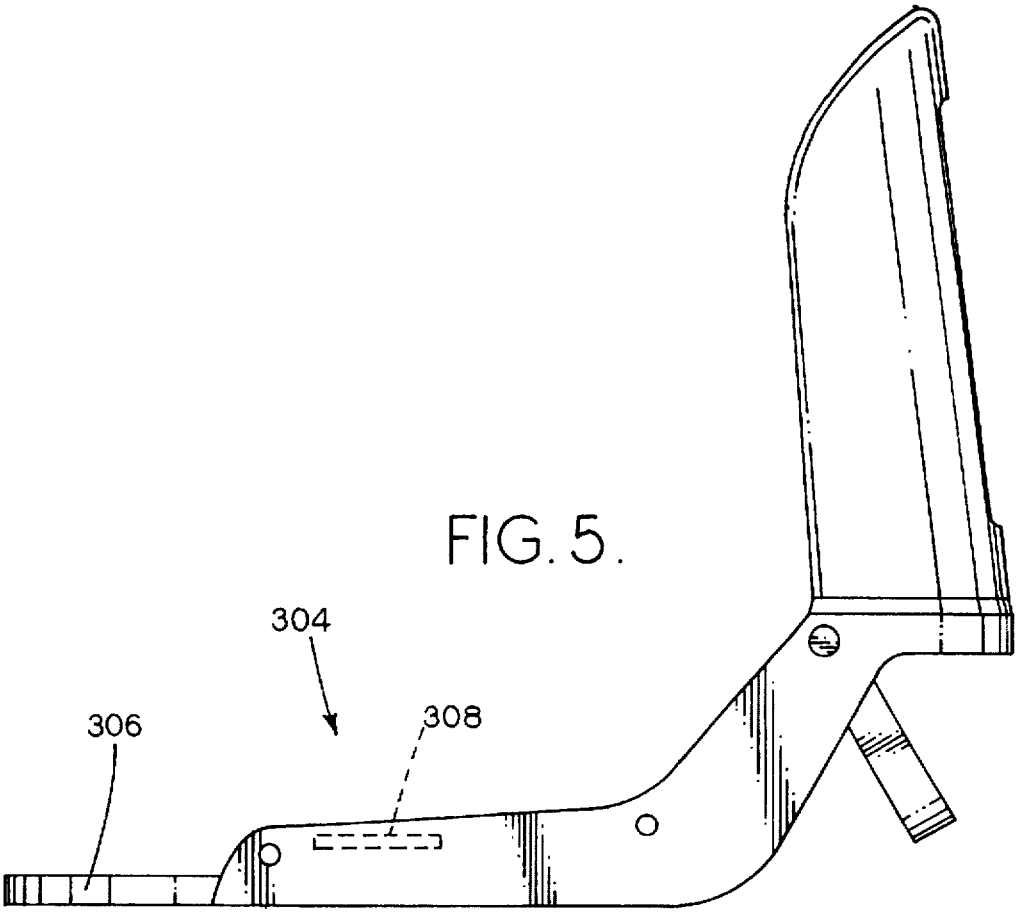
FIG. 5.
FIG. 6.
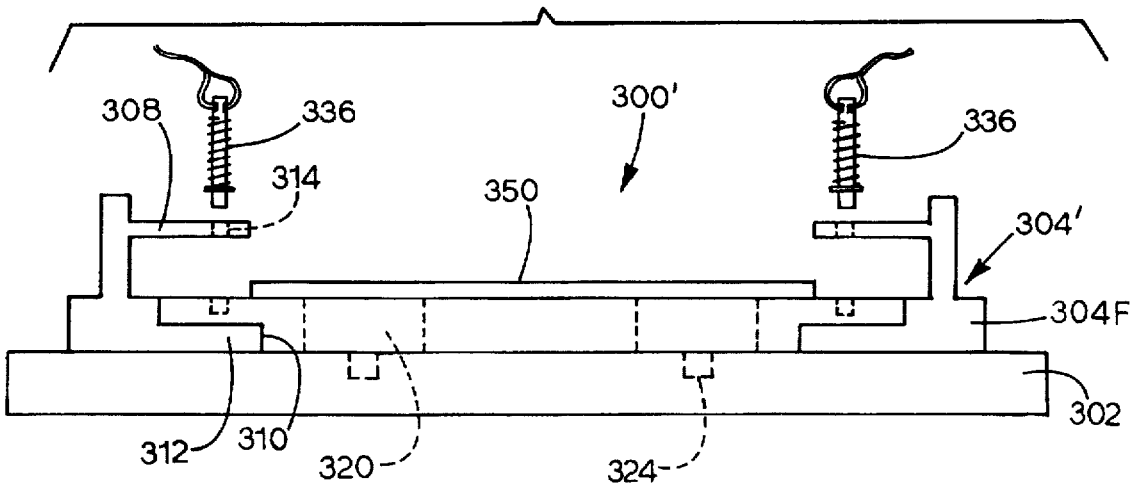

SNOWBOARD BINDING WHICH PERMITS ANGULAR REORIENTATION OF A USER'S FOOT WHILE MAINTAINING THAT FOOT ATTACHED TO THE SNOWBOARD

TECHNICAL FIELD OF THE INVENTION

The present invention relates to the general art of snowboarding, and to the particular field of bindings for snowboards. This is a continuation-in-part application of U.S. patent application Ser. No. 08/418,253, filed on Apr. 6, 1995 and now U.S. Pat. No. 5,553,883.

BACKGROUND OF THE INVENTION

Snowboarding has become extremely popular in recent times. Snowboarders generally adopt a stance with one foot in front of the other on a single board and ski using the single board. This activity has generated an entire subculture of enthusiasts and requires its own unique skills. For example, a snowboarder can place either his or her right or left foot forward on the board, can change stances or the like.

Generally, the forward foot is placed at an angle with respect to the longitudinal centerline of the snowboard during the snowboarding. Still further, most snowboarders like to have their feet as close to the snow as possible for reasons of control, comfort and the like. Still further, some snowboarders like to have their foot at one angle while others like to have their foot at another angle, and some snowboarders actually like to change the angle depending on conditions associated with the activity.

As noted above, most snowboarding is carried out with one foot, preferably the lead foot, oriented at an angle with respect to the longitudinal centerline of the snowboard. While this is effective and efficient for snowboarding, it is not desirable under all circumstances. Specifically, it is not desirable when skateboarding or when riding a ski lift. Skateboarding is effected by removing one foot, such as the rear foot, from the snowboard, and using that removed foot to contact the snow and propel the snowboarder forward in a skating movement. As can be understood, if the foot remaining attached to the snowboard is at an angle with respect to the longitudinal skateboarding will be uncomfortable and awkward and may even place undue stress on the snowboarder's body.

Another problem with the angled orientation of the snowboarder's foot on the snowboard occurs when the snowboarder is riding a ski lift. The angled orientation of the board with respect to the wearer may cause the board to be at an angle with respect to the wearer when that wearer is riding the ski lift. This may cause the board to contact other equipment or to contact other skier's equipment, or to be located in an undesired position. This, in turn, may require the wearer to twist his or her foot into an uncomfortable position while on the lift to hold the snowboard straight. Given the weight and length of the snowboard, holding the snowboard straight via twisting the foot or leg is very stressful to the body.

Presently available snowboard bindings have further drawbacks because such snowboard bindings do not permit the snowboarder to reorient the snowboard into a comfortable lift riding position. Therefore, some snowboarders are tempted to remove their snowboards when moving across level ground or when riding a ski lift. This is cumbersome. A further associated disadvantage is that when a snowboarder demounts a ski lift he or she must move out of line to refit the snowboard if it has been reoriented to permit comfortable ski lift riding. Holding the snowboard while riding the lift is a potential hazard for skier's below the lift path.

Still further, requiring the snowboarder to maintain his or her foot attached to a snowboard at an angle may be undesirable if the snowboarder wishes to alter his or her snowboarding style or technique during a snowboarding activity. Such altered style or technique may be required or desired due to changed snow conditions, changed slope conditions. The snowboarder may wish to change his or her speed of snowboarding, or even to change his or her style altogether, or to change the amount of control exerted over the activity.

In some conditions, the snowboarder may want to alter the angular orientation of his or her feet with respect to the snowboard to effect a change in style or the like. He or she may even want to switch his or her lead foot. He or she may even want both feet to be at an angle with respect to the snowboard longitudinal centerline.

The difference in styles and desires of snowboarders is most evident in the rental market. One snowboarder may have a preferred position and orientation with respect to the snowboard for a given condition, and skill level, while another snowboarder may have an entirely different position and orientation for the same condition. Therefore, rental snowboard bindings must be changed to suit the renter.

In the past, snowboard bindings have required that the snowboarder's foot be released from the snowboard and/or from the snowboard binding to effect any significant change in angular orientation of the foot with respect to the longitudinal centerline of the snowboard. The change is effected by removing the snowboarder's foot, loosening fasteners and removing anchoring means which attaches bindings to the snowboard, re-orienting the anchoring means, and re-attaching the fasteners to the snowboard, then re-attaching the snowboarder's foot to the anchoring means.

This procedure has several drawbacks which has inhibited both the overall popularity of the sport and the commercial market portion thereof. The procedure is often cumbersome and onerous and may not be easily carried out during a snowboarding activity. For example, a change from a snowboarding activity to a ski lift riding activity is not easily effected, nor is the reverse change from the orientation desired for riding the ski lift to the orientation desired to snowboard. Certainly, changing style or conditions are not easily accounted for if the snowboarder must stop and remove his or her foot from the board to effect the change in orientation of the foot with respect to the board. Not only is this inconvenient, it may even create a dangerous situation if the snowboarder cannot easily change his or her style, or foot orientation to meet changed conditions or the like. The removal of the snowboarder's foot from the board to effect a significant re-orientation of the foot with respect to the board may even require the use of tools, such as screwdrivers or the like. This is not desirable for many reasons, including the need to carry extra equipment. Still further, loosening and tightening of fasteners such as screws and bolts may cause these fasteners to strip threads and thereby become loose. This, at best, merely damages and degrades equipment, and at worst, may even create a dangerous condition if stripped threads are unknown to the snowboarder. Rental boards are particularly subject to degradation of equipment as they will nearly always be re-configured for each renter.

Still further, a requirement that the user's foot be removed from the board to reorient the foot creates the condition where, once attached to the board, the user's foot may be inadvertently disconnected from the board.

Experienced snowboarders generally prefer to have their feet as close to the plane of the snow as possible whereby the most control and "feel" can be realized. Skis generally have the bottom of the skier's boot placed directly on the upper surface of the ski so this control can be effected. However, the present inventor is not aware of any snowboards that permit the snowboarder to have the bottom plane of his foot as close to the plane of the snow as possible, i.e., nearly directly on top of the top surface of the snowboard, while also permitting easy and efficient reorientation of that foot with respect to the snowboard while his foot remains secured within the binding as above discussed.

If a snowboarder selects a certain orientation of his foot with respect to the snowboard for a given condition, and that condition arises again at a later time, the snowboarder should have the ability to accurately select that same orientation and still maintain confidence that the reaction of the snowboard will repeat the reaction experienced the previous time the orientation was selected. However, to the inventor's knowledge, no presently existing snowboard provides this repeatability feature in conjunction with the ability to accurately "feel" the snow and to quickly and efficiently change foot orientations while the foot remains attached to the binding and the snowboard. Such repeatability could be important for safety as the snowboarder may expect certain actions and reactions for the snowboard that result from a particular orientation of his foot on the board; if that orientation is not as precise as expected, the actions and reactions may differ enough in some conditions to raise a safety problem.

Therefore, there is a need for a binding for attaching a snowboarder's foot to a snowboard in a manner which permits significant reorientation of one or both of the user's feet with respect to the board without requiring the user's foot to be detached from the board whereby such reorientation can be effected quickly and easily without the need for tools and without the need for the snowboarder to stop a current activity for a great length of time. This binding should also permit the snowboarder to keep his or her foot attached to the snowboard when desired, and permit the snowboarder to keep his or her foot in a position with respect to both the board and the snow that is most desired and to have this foot position be repeatable with a high degree of confidence. There is a further need for a snowboard binding that permits the aforediscussed reorientation while positioning the snowboarder's foot as close to the plane of the snow as possible.

Snowboarders, like everyone else, are of different heights. Therefore, each snowboarder may have a stancewidth that is unique to him or her. As used herein, the term "stancewidth" means the distance between a snowboarder's feet on a snowboard. Even snowboarders of approximately the same height may have different stancewidths. The stancewidth that is most comfortable to an individual snowboarder should be used. Some snowboards might be manufactured for tall snowboarders or for short snowboarders; however, there is room for further improvement in this area as well.

Therefore, there is a need for a snowboard that can be customized for the particular stancewidth of each snowboader.

Still further, in order to achieve the maximum commercial success, it is desirable that presently available snowboards be changed as little as possible in order to achieve any result. If a snowboard must be substantially modified, manufacturers may not be inclined to offer the snowboard. Still further, if a snowboard can be modified to achieve results by a simple retrofit kit, such kits could be commercially successful.

Therefore, there is a need for a binding which can be sold to the snowboard market which will permit a snowboarder to replace a presently-available binding with a new binding that will permit him to change his or her stance on a snowboard to meet his or her individual desires while meeting the above-mentioned objectives yet without requiring modification to the snowboard.

OBJECT OF THE INVENTION

It is a main object of the present invention to provide a binding for a snowboard which permits quick and reliable re-orientation of the snowboarder's foot with respect to the snowboard.

It is another object of the present invention to provide a binding for a snowboard that permits a snowboarder to significantly alter the angular orientation of one or both of his or her feet with respect to the snowboard without releasing his or her feet or foot from the snowboard.

It is another object of the present invention to provide a binding for a snowboard that permits a snowboarder to significantly alter the angular orientation of one or both of his or her feet with respect to the snowboard without releasing his or her feet or foot from the snowboard while also positioning the snowboarder's foot as close to the plane of the snow as possible so efficient control of the snowboard can be effected by the snowboarder.

It is another object of the present invention to provide a binding for a snowboard that permits a snowboarder to significantly, accurately and repeatably alter the angular orientation of one or both of his or her feet with respect to the snowboard without releasing his or her feet or foot from the snowboard while also positioning the snowboarder's foot as close to the plane of the snow as possible so efficient control of the snowboard can be effected by the snowboarder.

It is another object of the present invention to provide a binding for a snowboard that permits a user to place his or her foot in an orientation on the board that is comfortable, even during skateboarding and riding a ski lift.

It is another object of the present invention to provide a binding for a snowboard that permits a snowboarder to alter the angular orientation of one or both of his or her feet with respect to the longitudinal centerline of the snowboard by as much as ninety degrees without releasing the foot or binding from the snowboard.

It is another object of the present invention to provide a binding for a snowboard that is light in weight.

It is another object of the present invention to provide a binding for a snowboard that permits a snowboarder to alter the angular orientation of one or both of his or her feet with respect to the longitudinal centerline of the snowboard so the foot can be moved from toes facing left of the longitudinal centerline to the toes facing right of that longitudinal centerline, and also allow the snowboarder to face either to the front of the snowboard or to the rear of the snowboard.

It is another object of the present invention to provide a binding for a snowboard that permits a snowboarder to alter the angular orientation of one or both of his or her feet with respect to the longitudinal centerline of the snowboard by as much as three hundred sixty degrees without releasing the foot from the snowboard.

It is another object of the present invention to provide a binding for a snowboard that permits a snowboarder to keep his feet the most comfortable position relative to the snow.

It is another object of the present invention to provide a binding for a snowboard that permits a snowboarder to keep his feet in the most comfortable position for the particular activity and conditions occurring at any given time.

It is another object of the present invention to provide a binding for a snowboard that permits a snowboarder to keep his feet in the most comfortable position for the particular activity and conditions occurring at any given time while being able to ensure with a very high degree of confidence that returning to a previous angular orientation can be accomplished.

It is another object of the present invention to provide a binding for a snowboard that is suitable for a rental market.

It is another object of the present invention to provide a binding for a snowboard that is suitable for easy use in a rental market.

It is another object of the present invention to provide a snowboard binding that can be customized for the particular stancewidth of each snowboader in addition to any customizing features presently available on a snowboard.

It is another object of the present invention to provide a snowboard binding that will permit a snowboarder to adjust the stancewidth to suit his or her individual needs.

It is another object of the present invention to provide a snowboard that can be modified by a snowboarder to change his or her stance on the snowboard to meet the individual's desires without requiring modification to the snowboard.

It is another object of the present invention to provide a kit that will permit a snowboarder to retrofit his or her snowboard whereby his or her snowboard can be easily modified to change his or her stance as desired.

It is another object of the present invention to provide a snowboard binding that will permit a snowboarder to adjust the binding to suit his or her individual needs while on the fly.

SUMMARY OF THE INVENTION

These, and other, objects are achieved by a binding that attaches a snowboarder's foot to a snowboard and maintains that foot attached to the snowboard even if the foot is moved through a significant angular reorientation with respect to the longitudinal centerline of the snowboard. This angular reorientation can be from an orientation having the toes facing toward the left of the centerline to an orientation having the toes facing to the right of the centerline, and can cover an angle of as much as ninety degrees or more and can even cover a complete circle of three hundred sixty degrees. It is significant that the foot remains continuously attached to the board during the reorientation. This permits rapid and easy reorientation of the user's foot without requiring special tools and ensures that the user's foot will remain attached to the board. Changing snow conditions, styles, desires, environments and the like can be easily accounted for. In fact, a change to "goofy foot" can be easily achieved by rotating the bindings and changing board directions (e.g., aft becomes forward and vice versa). Safety is increased and stress placed on the snowboarder is decreased given a condition or circumstance. Safety and control are further increased by the binding of the present invention which locates the bottom plane of the snowboarder's foot as close to the top plane of the snowboard as is possible whereby the bottom of the snowboarder's foot is as close to the plane of the snow as possible. This permits the snowboarder to effect the same amount of control over the snowboard as a skier effects for his or her skis.

Specifically, the binding includes a footplate that is attached to the snowboarder's foot, and means for rotatably and continuously attaching that footplate to the snowboard with the bottom of the footplate in direct contact with the top surface of the snowboard as well as means for securing the footplate against rotation when it has been placed in a desired orientation on the snowboard. The means for attaching the footplate to the snowboard has a top surface that is coplanar with the top surface of the footplate whereby the snowboarder's boot is as close to the plane of the top surface of the snowboard as possible.

It is noted that the preferred form of the invention is used for a snowboard; however, the present invention can be applied to waterboard by one skilled in the art based on the teaching of the present disclosure.

BRIEF DESCRIPTION OF THE DRAWING FIGURES

FIG. 5 is a side view of the footplate.

FIG. 6 is a front elevational view of another alternative form of the binding of the present invention.

DETAILED DESCRIPTION OF THE PREFERRED EMBODIMENT OF THE INVENTION

The present application is a continuation-in-part of application Ser. No. 08/418,253 filed on Apr. 6, 1995 by the inventor named herein and is presently pending. The present application fully incorporates by reference all of the disclosure in that pending application. Accordingly, the material disclosed in the pending application will not be repeated herein.

Figure 1:
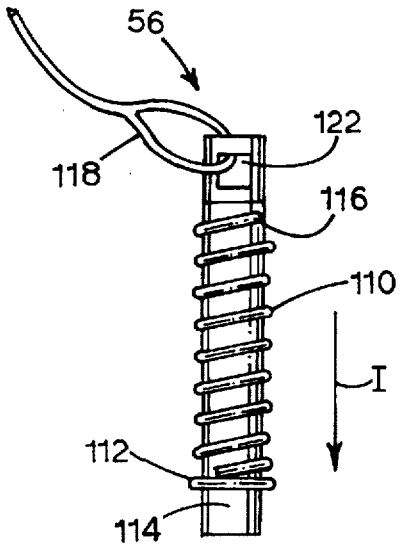
FIG. 1 is a side elevational view of an anti-pivot spring pin used to prevent the footplate from rotating on the snowboard.

Pins 56 are best shown in FIGS. 1, 8 and 9 of the incorporated patent application and is shown in FIG. 1 herein. Each of the pins 56 includes a spring 110 which bias it toward the snowboard so it must be forcefully pulled away from the snowboard to remove it from holes fixed to the snowboard by means disclosed hereinafter. Spring 110 surrounds each bolt and has one end 112 abutting a metal washer 114 on the bolt and another end 116 abutting an inner surface 118 of the footplate wing located adjacent to a hole in the flange of the footplate whereby the bolt is biased in direction I shown in FIGS. 1 and 2. Each bolt includes an eye 122 to which is attached a common "Y" leash as fully discussed in the incorporated material.

Figure 2:
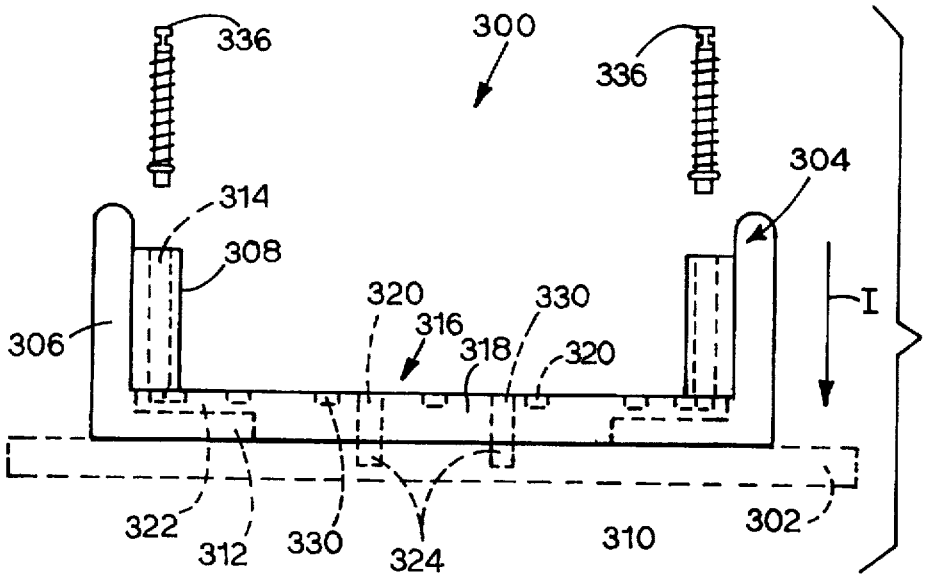
FIG. 2 is a front end elevational view of one form of the binding of the present invention.
Figure 3:
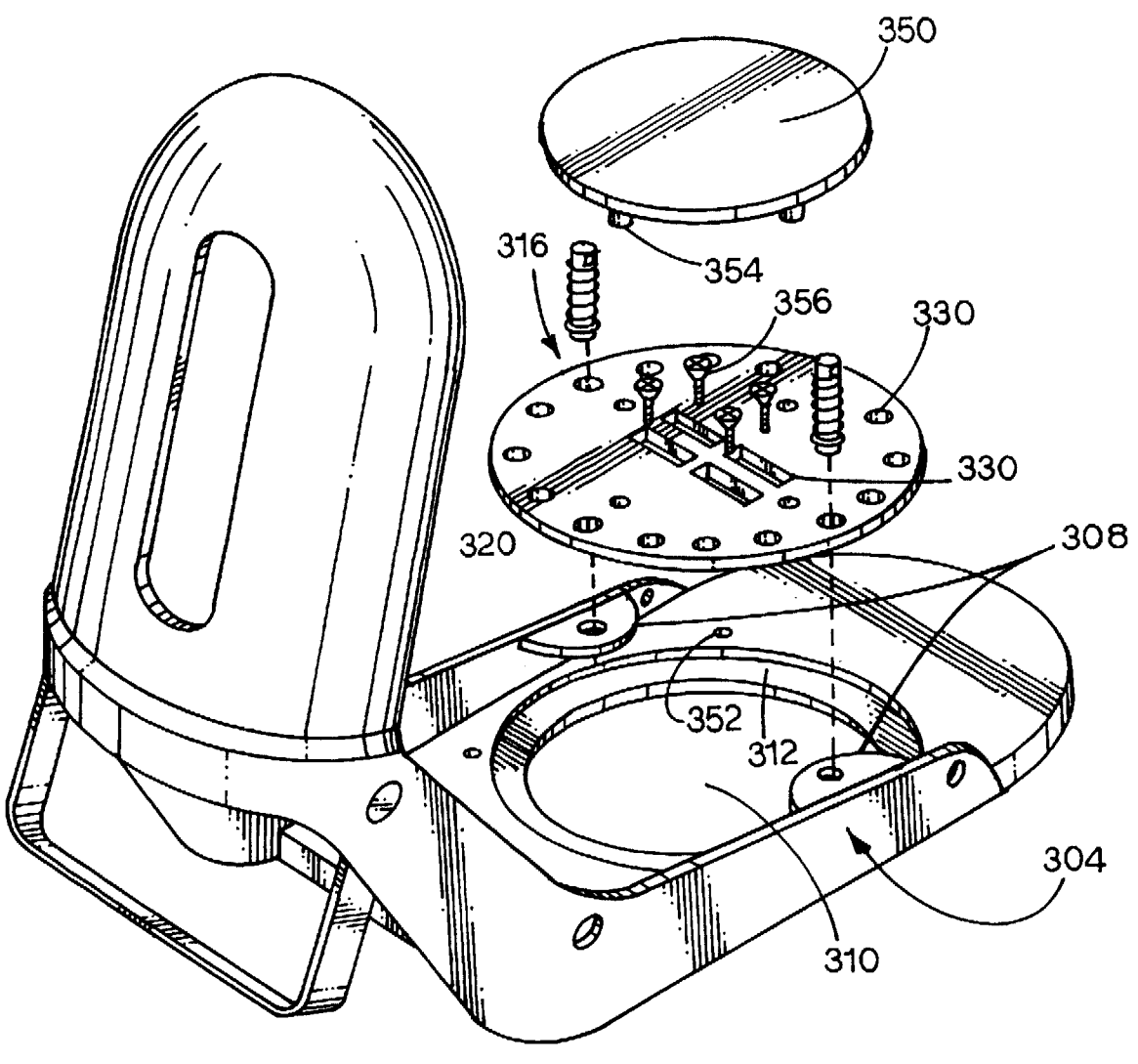
FIG. 3 is an exploded perspective view of the binding shown in FIG. 2.
Figure 4A:
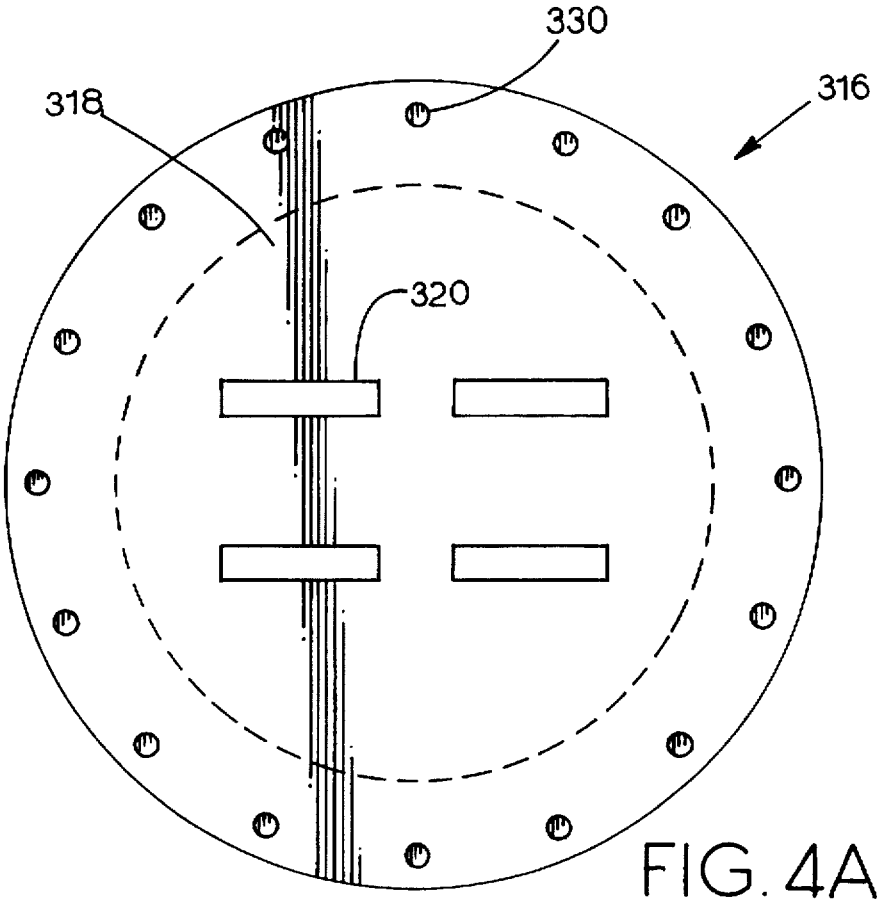
FIG. 4A is a top plan view of a top plate used with the form of the binding shown in FIG. 2
Figure 4B:
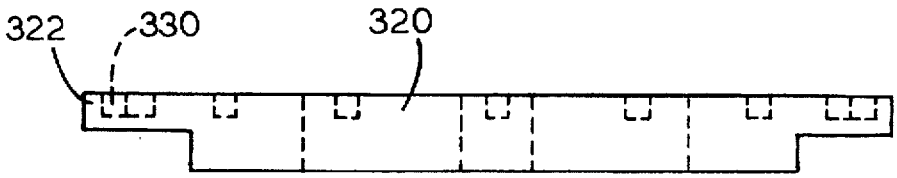
FIG. 4B is a side elevational view of the top plate.

The binding of the present invention is shown in FIGS. 2–4. Binding 300 can be used with a snowboard 302 without modifying snowboard 302. Thus, binding 300 could be retrofit onto and used with existing snowboards. Furthermore, binding 300 has means for adjusting the spacing between a binding located adjacent to a fore end of the snowboard and a binding located adjacent to an aft end of the snowboard. Therefore, if a snowboarder uses binding 300 he or she can adjust the bindings on the board to accommodate the stancewidth that is most comfortable to them at that time. The stancewidth can even be adjusted by the same snowboarder to meet different conditions. Still further, the binding 300 can be used on a rental board whereby the rental board can be easily customized for each renter. This customization includes both foot orientation on the board and stancewidth. The binding 300 is also easy to use whereby the snowboarder can adjust the angular orientation of his foot on the board on the fly.

Binding 300 is very similar to the binding disclosed in the incorporated material, and thus only details specific to binding 300 will be discussed. The advantages associated with the incorporated binding are also realized with binding 300. However, binding 300 has additional advantages of being capable of placement on an existing snowboard without modifying that existing snowboard, and further permitting adjustment of stancewidth. Specifically, binding 300 includes a footplate 304, also shown in FIG. 5, that will be attached to a snowboarder's boot in the manner discussed in the incorporated material. Footplate 304 includes two side elements, such as side element 306 having a flange 308 thereon. Flanges 308 extend toward each other as shown in FIGS. 2 and 3. The footplate includes a hole 310 defined therethrough and a flange 312 on the footplate adjacent to the hole. Each of the flanges 308 includes a bore, such as bore 314, defined therethrough.

An anchor means secures the footplate to the snowboard, and includes a top plate 316 having a central body 318 having a plurality of elongate holes, such as hole 320, defined therethrough and a flange 322 surrounding the central body. Holes 320 are located to coincide with holes, such as hole 324, defined in the snowboard by the manufacturer. A fastener, such as a screw or the like, fits through holes 320 and 324 to fixedly attach the top plate to the snowboard. The elongate shape of holes 320 permits the top plate to be moved on the snowboard with respect to the snowboard. The elongate holes 320 are oriented longitudinally of the snowboard whereby the top plate can be moved longitudinally of the snowboard. In this manner, the top plate can be moved forward or aft of the snowboard. If there are two bindings, one adjacent to the forward end of the snowboard and one adjacent to the aft end of the snowboard, these two top plates can be moved toward or away from each other to adjust the spacing between the bindings. This will permit a user to adjust the snowboard to accept the stancewidth that is desired further to any adjustment that is available on the snowboard.

Top plate 316 further includes a plurality of holes, such as hole 330, defined therein. The holes 330 extend for more than ninety degrees and preferably for three hundred sixty degrees around the circumference of the top plate. Preferably, the holes are spaced apart by a three degree arc length; however, other spacings can be used without departing from the scope of this invention.

As can be seen in FIG. 2, flange 312 of the footplate is slidably received beneath flange 322 of the top plate to capture the footplate beneath the top plate. This fixes the footplate to the snowboard via the top plate. The footplate is free to rotate on the snowboard when the flanges are thus engaged. The footplate is rotated until the snowboarder is satisfied with the orientation of the footplate with respect to the snowboard, and is then fixed in the selected orientation. The footplate is fixed by securing it to the top plate. Fastening means, such as pins 336 are used to connect the footplate to the top plate. Pins 336 are identical to the pins 56 discussed above, and thus will not be further discussed. Pins 336 fit through bores 314 and are received in holes 330 thereby fixing the footplate to the top plate. The accommodation of the pins in holes 330 makes the angular orientation of the snowboarder's foot on the snowboard repeatable. That is, an angular orientation can be selected and changed if conditions change. However, if the conditions change back, the snowboarder can re-set the initial angular orientation knowing that the initial orientation will be identical. As can also be seen, due to the ease of use, the snowboarder, if he is sufficiently skilled, can actually adjust the angular orientation of his foot on the snowboard on the fly. As can be understood from this description, holes 330 are located outside the perimeter of a snowboarder's foot in the binding, but inside the outer perimeter of the footplate.

Another form of the invention is shown in FIG. 6 in which binding 300' includes a footplate 304' and a top plate 316. The footplate 304' includes two flanges 304F, but the footplate 304' and the binding 300' are otherwise similar to footplate 304 and binding 300.

Figure 7:
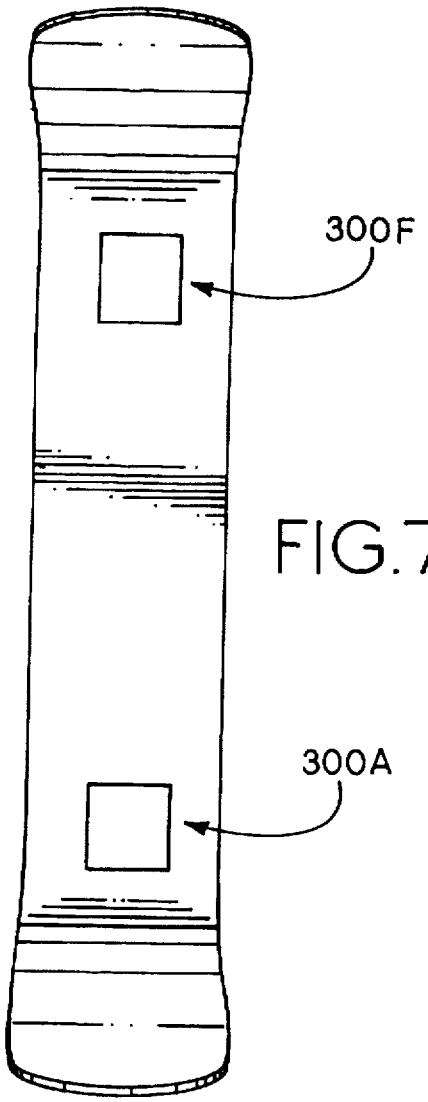
FIG. 7 is a top plan view showing two bindings on a snowboard.

As shown in FIG. 7, two bindings can be used on one snowboard. As shown in FIG. 7, the bindings form a means for attaching a snowboarder's feet to a snowboard and comprise a first footplate 304F having an outer perimeter and means for attaching the first footplate directly to a snowboarder's boot when the snowboarder's foot is in the boot. First footplate 304F has a bottom surface which is positioned in direct contact with a top surface of the snowboard thereby placing a wearer's foot immediately adjacent to the top surface of the snowboard. First binding 300F further includes a first anchor means for rotatably attaching the first footplate with the foot-containing boot attached thereto to a snowboard and maintaining the first footplate and foot-containing boot continuously attached to the snowboard even when the first footplate is rotated through an angle of ninety degrees or more with respect to a longitudinal centerline of the snowboard. The first anchor means includes a first top plate, such as top plate 316, a first fastening means, for fixedly attaching the first top plate to the snowboard, and first means, such as the above-discussed slidably engaged flanges 312 and 322, movably engaging the first top plate with the first footplate. The means shown in FIG. 7 further includes first securing means, such as pins 56 or 336, for accurately, releasably and repeatable securing the first footplate to the first top plate in a selected angular orientation and for preventing movement of the first footplate with respect to the first top plate. The first securing means includes a plurality of first holes, such as hole 330, defined in the first top plate, with the first holes being arcuately arranged with respect to the snowboard and located outside of the outer perimeter of a user's foot on the footplate. The means shown in FIG. 7 further includes a second footplate 304A having an outer perimeter and means for attaching the second footplate directly to a snowboarder's boot when the snowboarder's foot is in the boot. The second footplate has a bottom surface positioned in direct contact with a top surface of the snowboard thereby placing a wearer's foot immediately adjacent to the top surface of the snowboard. Binding 300A further includes a second anchor means for rotatably attaching the second footplate with the foot-containing boot attached thereto to the snowboard and maintaining the second footplate and foot-containing boot continuously attached to the snowboard even when the second footplate is rotated through an angle of ninety degrees or more with respect to a longitudinal centerline of the snowboard. The second anchor means, in a manner similar to the first anchor means, includes a second top plate, a second fastening means for fixedly attaching the second top plate to the snowboard, and second means movably engaging the second top plate with the second footplate. The binding 300A also includes second securing means for accurately, releasably and repeatable securing the second footplate to the second top plate in a selected angular orientation and for preventing movement of the second footplate with respect to the second top plate. The second securing means further includes a plurality of second holes defined in the second top plate, with the second holes being arcuately arranged with respect to the snowboard and located outside of the outer perimeter of a user's foot on the footplate and inside the perimeter of the footplate.

A cover plate 350, shown in FIGS. 3 and 5 is used to prevent snow or other debris from entering the mechanism. Plate 350 is attached to the footplate by fastening means which includes holes 352 defined in the footplate and tabs 354 on the plate. As shown in FIG. 3, fastener means, such as screws 356, fasten the top plate to the snowboard via elongate holes 320.

It is understood that while certain forms of the present invention have been illustrated and described herein, it is not to be limited to the specific forms or arrangements of parts described and shown.

I claim:

1. A binding for attaching a snowboarder's foot to a snowboard comprising:

A) a footplate having an outer perimeter and means for attaching said footplate directly to a snowboarder's boot when the snowboarder's foot is in the boot, said footplate having a bottom surface, said bottom surface being positioned in direct contact with a top surface of the snowboard thereby placing a wearer's foot immediately adjacent to the top surface of the snowboard;

B) anchor means for rotatably attaching said footplate with the foot-containing boot attached thereto to a snowboard and maintaining said footplate and foot-containing boot continuously attached to said snowboard even when said footplate is rotated through an angle of ninety degrees or more with respect to a longitudinal centerline of the snowboard, said anchor means including (1) a top plate having a plurality of arcuately spaced apart holes defined therein, said holes being located outside the perimeter of the user's foot on said top plate, (2) fastening means for fixedly attaching said top plate to the snowboard, and (3) means movably engaging said top plate with said footplate; and C) securing means on said footplate for accurately, releasably and repeatable securing said footplate to said top plate in a selected one of a plurality of angular orientations and for preventing movement of said footplate with respect to said top plate, said footplate being located between said top plate and the snowboard.

2. The binding defined in claim 1 wherein said securing means further includes a hole in said footplate and a fastener means for securing said footplate to said top plate when accommodated in the hole in said footplate and in one of the holes in said top plate.

3. A binding for attaching a snowboarder's foot to a snowboard comprising:

A) a footplate having an outer perimeter, a bottom surface and means for attaching said footplate to a snowboarder's boot when a snowboarder's foot is in the boot;

B) anchor means for rotatably attaching said footplate with the snowboarder's boot attached thereto to a snowboard having a top surface and a longitudinal centerline, said anchor means positioning said bottom surface in direct contact with the top surface of the snowboard and maintaining said footplate and snowboarder's boot continuously attached to the snowboard even when said footplate is rotated through an angle of ninety degrees or more with respect to the longitudinal centerline of the snowboard, said anchor means including (1) first fastening means fixed to the snowboard for fixedly attaching said anchor means to the snowboard and including a plurality of holes defined in said first fastening means, said plurality of holes on said first fastening means extending on said first fastening means for at least a ninety degree arc which extends across the longitudinal centerline of the snowboard and which are located outside the outer perimeter of a user's foot on said snowboard, said footplate being located between said first fastening means and the snowboard, (2) second fastening means for rotatably attaching said footplate to said first fastening means, said second fastening means being in sliding contact with said first fastening means and remaining in continuous sliding contact with said first fastening means when said footplate is rotated through said angle, and (3) securing means on said footplate for engaging at least one of the holes on said first fastening means for accurately and repeatable securing said footplate to said first fastening means in a selected one of a plurality of angular orientations, said securing means including at least one hole in said footplate.

4. A binding for attaching a snowboarder to a snowboard comprising:

A) a footplate means for securing a boot to a snowboard, said footplate means having a bottom surface and a base, and including means for mounting said footplate in direct and sliding contact with the snowboard, said means for mounting said footplate including (1) pin means;

(2) pin accommodating means on said footplate for holding said pin means on said footplate, (3) pin receiving means fixed to the snowboard with said footplate located between said pin receiving means and the snowboard for releasably receiving said pin means and attaching said footplate means to the snowboard, said pin receiving means including a plurality of holes defined therein to be located outside an outer perimeter of a snowboarder's foot located in a boot attached to said footplate means and extending for an arc of at least ninety degrees with respect to a longitudinal centerline of the snowboard, and (4) means for slidably connecting said pin receiving means to said footplate means whereby said footplate can be rotated at least ninety degrees on the snowboard without being detached from the snowboard.

5. The binding defined in claim 4 wherein said footplate has a flange thereon and an opening defined through said flange, said pin means fitting through the hole defined in said flange.

6. The binding defined in claim 1 wherein the fastening means for fixedly attaching said top plate to the snowboard further includes mounting holes defined in said top plate, anchor receiving holes defined in the snowboard, and anchor fastening means for fixedly attaching said top plate to the snowboard via said mounting holes and the holes defined in the snowboard.

7. The binding defined in claim 6 wherein the mounting holes defined in said top plate are elongate.

8. The binding defined in claim 7 wherein the snowboard includes a front end and an aft end and said binding is located adjacent to said front end and further including a second binding located adjacent to said aft end.

9. The binding defined in claim 1 wherein said plurality of holes defined in said top plate extend for three hundred sixty degrees.

10. The binding defined in claim 9 wherein said footplate includes two side edges and said securing means includes a wing on each of said side edges.

11. The binding defined in claim 10 wherein said securing means for securing said footplate to said top plate includes a pin, spring means for biasing said pin into engagement with one of the plurality of holes in said top plate and release means on said pin for removing said pin from engagement with said one hole to permit said footplate to rotate with respect to the snowboard while said footplate remains secured to the snowboard.

12. The binding defined in claim 1 wherein said anchor means for rotatably attaching said footplate with the foot-containing boot attached thereto to a snowboard further includes an annular flange on said footplate, and a second annular flange on said top plate, said annular flange on said footplate being slidably received beneath said second annular flange.

13. A binding for attaching a waterboarder's foot to a waterboard comprising:

A) a footplate having an outer perimeter and means for attaching said footplate directly to a waterboarder's foot when the waterboarder's foot is in a binding, said footplate having a bottom surface, said bottom surface being positioned in direct and sliding contact with a top surface of the waterboard thereby placing a wearer's foot immediately adjacent to the top surface of the waterboard;

B) anchor means for rotatably attaching said footplate with the foot-containing binding attached thereto to a waterboard and maintaining said footplate and foot-containing boot continuously attached to said waterboard even when said footplate is rotated through an angle of ninety degrees or more with respect to a longitudinal centerline of the waterboard, said anchor means including (1) a top plate, said footplate being located between said top plate and the waterboard, (2) fastening means for fixedly attaching said top plate to the waterboard, and (3) means movably engaging said top plate with said footplate; and C) securing means for accurately, releasably and repeatable securing said footplate to said top plate in a selected angular orientation and for preventing movement of said footplate with respect to said top plate, said securing means including a plurality of holes defined in said top plate, said holes being arcuately arranged with respect to the waterboard and located outside of the outer perimeter of a user's foot on said footplate and means on said footplate for engaging said holes to lock said footplate in one of a plurality of angular orientations with respect to the waterboard.

14. A binding for attaching a snowboarder to a snowboard comprising:

A) a footplate secured to a snowboarder's boot, said footplate having an outer perimeter, a bottom surface and a base, and including (1) means on said base for mounting pin means on said base, and (2) mounting means on said base for fixing said footplate to the snowboarder's boot;

B) pin means for releasably fixing said footplate in a selected orientation on the snowboard;

C) a pin receiving means on a snowboard for releasably receiving said pin means and maintaining said footplate in a selected orientation on the snowboard with respect to a longitudinal centerline of the snowboard, said pin receiving means including a plurality of holes defined therein to be located outside a perimeter of a user's foot when that user's foot is attached to the snowboard by said footplate and extending for at least a ninety degree arc which extends across the longitudinal centerline whereby said footplate can be rotated at least ninety degrees on the snowboard;

D) fastening means for securing said footplate to the snowboard and maintaining said footplate continuously secured to the snowboard with said footplate bottom surface in direct and sliding contact with the top surface of the snowboard when said footplate is rotated with the snowboarder's foot in the boot and attached to said footplate, said fastening means including a flange;

E) anchor means for fixing said fastening means to the snowboard; and

F) connection means for movably connecting said fastening means to said footplate and for permitting said footplate to rotate with respect to said fastening means with said fastening means fixed to the snowboard, said fastening means including a flange which slidably contacts the flange of said fastening means, said footplate being located between said fastening means and the snowboard.

15. A binding for attaching a snowboarder to a snowboard comprising:

A) a footplate having means for securing said footplate to a snowboarder's boot, said footplate having an outer perimeter, a bottom surface and a base, and including (1) means on said base for mounting pin means on said base, and (2) mounting means on said base for fixing said footplate to the snowboarder's boot;

B) pin means for releasably fixing said footplate in a selected orientation on the snowboard;

C) a pin receiving means on a snowboard for releasably receiving said pin means and maintaining said footplate in a selected orientation on the snowboard with respect to a longitudinal centerline of the snowboard, said pin receiving means including a plurality of holes defined therein to be located outside a perimeter of a user's foot when that user's foot is attached to the snowboard by said footplate and extending for at least a ninety degree arc which extends across the longitudinal centerline whereby said footplate can be rotated at least ninety degrees on the snowboard;

D) fastening means for securing said footplate to the snowboard and maintaining said footplate continuously secured to the snowboard with said footplate bottom surface in direct and sliding contact with the top surface of the snowboard when said footplate is rotated with the snowboarder's foot in the boot and attached to said footplate;

E) anchor means for fixing said fastening means to the snowboard; and

F) connection means for movably connecting said fastening means to said footplate and for permitting said footplate to rotate with respect to said fastening means with said fastening means fixed to the snowboard, said footplate being located between said fastening means and the snowboard.

16. A binding for attaching a snowboarder to a snowboard comprising:

A) a footplate having means for securing said footplate to a snowboarder's boot, said footplate having an outer perimeter, a bottom surface and a base, and including
(1) means on said base for mounting pin means on said base, and
(2) mounting means on said base for fixing said footplate to the snowboarder's boot;

B) pin means for releasably fixing said footplate in a selected orientation on the snowboard;

C) a pin receiving means on a snowboard for releasably receiving said pin means and maintaining said footplate in a selected orientation on the snowboard with respect to a longitudinal centerline of the snowboard, said pin receiving means including a plurality of holes defined therein to be located outside a perimeter of a user's foot when that user's foot is attached to the snowboard by said footplate and extending for at least a ninety degree arc which extends across the longitudinal centerline whereby said footplate can be rotated at least ninety degrees on the snowboard;

D) fastening means for securing said footplate to the snowboard and maintaining said footplate continuously secured to the snowboard with said footplate bottom surface in direct and sliding contact with the top surface of the snowboard when said footplate is rotated with the snowboarder's foot in the boot and attached to said footplate, said fastening means including a flange;

E) anchor means for fixing said fastening means to the snowboard; and

F) connection means for movably connecting said fastening means to said footplate and for permitting said footplate to rotate with respect to said fastening means with said fastening means fixed to the snowboard, said securing means including a flange which slidably contacts the flange of said fastening means, said footplate being located between said fastening means and the snowboard.

17. The binding defined in claim 3 wherein said anchor means further includes a hole defined in the snowboard, and elongate holes defined in said first fastening means.

18. A means for attaching a snowboarder's feet to a snowboard comprising:

A) a first footplate having an outer perimeter and means for attaching said first footplate directly to a snowboarder's boot when the snowboarder's foot is in the boot, said first footplate having a bottom surface, said bottom surface being positioned in direct contact with a top surface of the snowboard thereby placing a wearer's foot immediately adjacent to the top surface of the snowboard;

B) first anchor means for rotatably attaching said first footplate with the foot-containing boot attached thereto to a snowboard and maintaining said first footplate and foot-containing boot continuously attached to said snowboard even when said first footplate is rotated through an angle of ninety degrees or more with respect to a longitudinal centerline of the snowboard, said first anchor means including
(1) a first top plate,
(2) first fastening means for fixedly attaching said first top plate to the snowboard, and
(3) first means movably engaging said first top plate with said first footplate;

C) first securing means for accurately, releasably and repeatable securing said first footplate to said first top plate in a selected angular orientation and for preventing movement of said first footplate with respect to said first top plate, said first securing means including a plurality of first holes defined in said first top plate, said first holes being arcuately arranged with respect to the snowboard and located outside of the outer perimeter of a user's foot on said footplate;

D) a second footplate having an outer perimeter and means for attaching said second footplate directly to a snowboarder's boot when the snowboarder's foot is in the boot, said second footplate having a bottom surface, said bottom surface being positioned in direct and sliding contact with a top surface of the snowboard thereby placing a wearer's foot immediately adjacent to the top surface of the snowboard;

E) second anchor means for rotatably attaching said second footplate with the foot-containing boot attached thereto to a snowboard and maintaining said second footplate and foot-containing boot continuously attached to said snowboard even when said second footplate is rotated through an angle of ninety degrees or more with respect to a longitudinal centerline of the snowboard, said second anchor means including
(1) a second top plate,
(2) second fastening means for fixedly attaching said second top plate to the snowboard, and
(3) second means movably engaging said second top plate with said second footplate; and F) second securing means for accurately, releasably and repeatable securing said second footplate to said second top plate in a selected angular orientation and for preventing movement of said second footplate with respect to said second top plate, said second securing means including a plurality of second holes defined in said second top plate, said second holes being arcuately arranged with respect to the snowboard and located outside of the outer perimeter of a user's foot on said footplate, said footplate being located between said second securing means and the snowboard.

19. The means defined in claim 18 wherein said first and second anchor means are spaced from each other and further including means for adjusting the spacing between said first and second anchor means.

20. The means defined in claim 18 wherein said first anchor means includes a first hole defined in the snowboard, and a first elongate hole defined in said first top plate, and said second anchor means includes a second hole defined in the snowboard and a second elongate hole defined in said second top plate.

21. The means defined in claim 19 wherein the snowboard includes a fore end and an aft end, with said first anchor means being located adjacent to said fore end and said second anchor means being located adjacent to said aft end.

22. The binding defined in claim 4 wherein said plurality of holes are located inside the perimeter of the footplate.

23. A binding for attaching a snowboarder's foot to a snowboard comprising:

A) a footplate rotatably mounted on a snowboard;

B) means for attaching a snowboarder's foot to said footplate;

C) a top plate having a plurality of angularly spaced apart holes defined therein, said footplate being positioned between the snowboard and said top plate; and D) means for attaching said footplate to said top plate and having means for co-operatively engaging said holes to fix said footplate in a selected one of a plurality of positions on the snowboard.

24. The binding defined in claim 1 wherein said means for attaching the footplate to the snowboarde's boot has an outer perimeter and said securing means is located inside the outer perimeter of the means for attaching the footplate to the snowboarder's boot.

25. The binding defined in claim 3 wherein said means for attaching the footplate to the snowboarder's boot has an outer perimeter and said securing means is located inside the outer perimeter of the means for attaching the footplate to the snowboarder's boot.

26. The binding defined in claim 4 wherein said footplate means includes means for attaching the footplate means to the snowboarder's boot, said attaching means having an outer perimeter, said securing means being located inside the outer perimeter of the means for attaching the footplate to the snowboarder's boot.

27. The binding defined in claim 13 wherein said means for attaching the footplate to the waterboarder's foot has an outer perimeter and said securing means is located inside the outer perimeter of the means for attaching the footplate to the waterboarder's foot.

28. The binding defined in claim 14 said mounting means for fixing the fooplate to the snowboarder's boot has an outer perimeter and said pin receiving means is located inside the outer perimeter of the means for fixing the footplate to the snowboarder's boot.

29. The binding defined in claim 15 wherein said means for securinging the footplate to the snowboarder's boot has an outer perimeter and said pin means is located inside the outer perimeter of the means for securing the footplate to the snowboarder's boot.

30. The binding defined in claim 16 wherein said means for securing the footplate to the snowboarder's boot has an outer perimeter and said pin means is located inside the outer perimeter of the means for securing the footplate to the snowboarder's boot.

31. The means defined in claim 18 wherein said means for attaching the first footplate to the snowboarder's boot has an outer perimeter and said first securing means is located inside the outer perimeter of the means for attaching the footplate to the snowboarder's boot.

* * * * *